US006918142B1

(12) United States Patent
Wainwright et al.

(10) Patent No.: US 6,918,142 B1
(45) Date of Patent: Jul. 19, 2005

(54) LIFTING APPARATUS

(76) Inventors: Gary S. Wainwright, 8665 Sudley Rd., #316, Manassas, VA (US) 20110; Cindy W. Davis, 11526 Olde Tiverton Cir., #303, Reston, VA (US) 20194

( * ) Notice: Subject to any disclaimer, the term of this patent is extended or adjusted under 35 U.S.C. 154(b) by 0 days.

(21) Appl. No.: 10/778,659

(22) Filed: Feb. 12, 2004

Related U.S. Application Data

(60) Provisional application No. 60/503,928, filed on Sep. 17, 2003.

(51) Int. Cl.[7] ..... A47K 13/10
(52) U.S. Cl. ..... 4/246.1; 16/111.1
(58) Field of Search ..... 4/246.1, 246.3; 16/110.1, 111.1, 443, 905

(56) References Cited

U.S. PATENT DOCUMENTS 752,321 A * 2/1904 Bacon ..... 4/246.1
4,133,062 A * 1/1979 Fulbright, Jr. ..... 4/246.1
4,835,799 A 6/1989 Beelart et al.
5,341,519 A * 8/1994 Cusenza ..... 4/246.1
5,375,267 A 12/1994 Davis
5,459,889 A 10/1995 Jamison
5,461,733 A * 10/1995 McKee ..... 4/246.1
5,727,258 A 3/1998 Derouin
5,933,876 A 8/1999 Simonds

* cited by examiner

*Primary Examiner*—Charles E. Phillips
(74) *Attorney, Agent, or Firm*—Richard S. Erbe

(57) ABSTRACT

An apparatus for lifting an element of a hinged structure includes an enclosure having one or more springs within the enclosure. A handle attached to one of the springs projects out of an elongated slot in the enclosure to provide easy access to a user. The apparatus may be attached to a surface of a hinged element, such as a toilet seat. When the toilet seat is down, a person may lift the seat by grasping the handle with one or more fingers of one hand and sliding the handle towards them. By providing a lifting motion in conjunction with the pulling action, the person can easily raise the toilet seat without having to touch it or any other part of the toilet seat.

13 Claims, 2 Drawing Sheets

LIFTING APPARATUS

RELATED APPLICATIONS

This application claims the benefit of U.S. Provisional Patent Application No. 60/503,928, filed Sep. 17, 2003, incorporated herein by reference.

BACKGROUND OF THE INVENTION

1. Field of the Invention

The present invention relates to a device for lifting an element of a hinged structure. In particular, the present invention relates to a device for attachment to a toilet seat that can enable a person to lift the seat without touching the seat, lid, or toilet bowl with the person's hands.

2. General Background and State of the Art

The use of lifting devices for hinged devices such as toilet seats is known in the prior art. In our society, people are very sensitive to sanitary issues, such as the transmission of germs that can occur when touching surfaces that have recently been touched by another person. This is especially true in the case of toilet seats in public bathroom facilities, such as in places of business and on airplanes. It is quite common these days for an individual to lift a toilet seat in a public facility to examine underneath the seat before using it.

Known devices have a number of common characteristics. Such devices are generally unsightly and can cause safety problems, such as injury to the person when impacting them. Also, these known devices can cause tearing and tangling of clothing articles because of their location. Another problem inherent in many of such devices is that they cannot easily be operated by children, elderly people, or people having physical limitations.

Another problem with some of the prior art devices is that they are not integral with a toilet seat, so one would have to carry such a device when using a toilet in a public facility. Having to do so is very inconvenient, and an individual boarding an airplane may have difficulty bringing such a device through a security checkpoint prior to boarding the airplane.

One such device is disclosed in U.S. Pat. No. 4,835,799 (Beelart, Jr.). Beelart, Jr., discloses a portable handle having a jaw member that can be attached to a toilet seat when a person wishes to lift it. The Beelart device is not integral with the toilet seat and is not easily operable by elderly or very young persons.

Another known prior art device is disclosed in U.S. Pat. No. 5,375,267 (Davis). Davis discloses a hinged handle that is attached in a fixed position to the underside of the toilet seat. The handle is pivotable and may be secured in a downward orientation when not in use. The device is best used when mounted near the front of the toilet. The device therefore does present a possible tearing or tangling hazard to clothing.

U.S. Pat. No. 5,459,889 (Jamison) discloses a handle affixed to the underside of a toilet seat near the forward portion of the seat. The handle can be latched to a retention strap mounted on the side of the toilet when the seat is in the upward position. When the toilet seat is in its down position, the Jamison device presents a tearing and tangling hazard to clothes, and is not easily operated by elderly or very young persons.

U.S. Pat. No. 5,727,258 (Derouin) discloses a toilet seat-lifting handle fixed to the underside of a toilet seat near the forward part of the seat. The handle provides the ability to apply scented materials to the area around the bowl. The handle can be rotated into a number of orientations. Its position near the front of the toilet presents a tearing and tangling hazard to clothing.

U.S. Pat. No. 5,933,876 (Simonds) provides a portable clip-on handle that grips the top and bottom portions of a toilet seats. The device is not integral with the toilet seat and so must be carried into public bathroom facilities by a user. It also appears that the force that must be applied to the device for use would make it difficult for elderly and very young persons to operate.

There is therefore a need for a lifting device that is integral with the hinged structure.

There is also a need for a lifting device that is easy for people of all ages and physical conditions to operate.

There also exists a need for a lifting device that does not present a tearing and tangling hazard to clothing.

None of the known prior art devices, either singularly or in combination, are able to provide all of the features described above.

SUMMARY OF THE INVENTION

Accordingly, it is an object of the invention to provide a lifting device for lifting an element of a hinged structure that is easy to operate and does not require much in the way of strength to use.

An additional object of the invention is to provide a lifting device that does not present a tearing and tangling hazard to clothing.

A further another object of the invention to provide a toilet seat lifting device that is integral with the hinged structure.

Still another object of the invention is to provide a toilet seat-lifting device that is durable and sanitary.

These and other objectives are achieved by the present invention, which, in a broad aspect, provides the user with a spring-actuated device for lifting a hinged structure, particularly a toilet seat. The device is attached to the underside of the toilet seat and is configured so that when a person is using the toilet, it does not present a hazard to a person's body or clothing. It should be understood that the present invention may be applied to lift an element of a variety of hinged structures, such as a refuse receptacle, a recycling container, and the like.

A device according to the preferred embodiment of the present invention provides an elongated enclosure in which is secured one or more springs. The enclosure may be cylindrical or rectangular in cross section. The long sides of the enclosure closely follow the contour of a toilet seat edge.

The enclosure is sized so that in width it is smaller than the lip legs on the underside of the toilet seat, and thus will not interfere with the manner in which the lip legs support the toilet seat in the down position. The enclosure further has an opening that parallels the toilet seat edge and extends for most of the length of the enclosure.

The opening is sized to allow a small handle, which is attached a spring, to protrude through the opening. The opening is oriented so that the handle extends beyond the outer edge of the toilet seat and thus can be seen and grasped by a person.

When the device is not in use, the handle is located near the rear of the toilet seat, away from the user. To use the device, a person grasps the handle and slides the handle towards the front of the toilet seat. By including a lifting action, the handle slides forward, following the path of the opening and compressing or extending the spring and lifting the toilet seat. Once the toilet seat is in its desired position, the person can release the handle, which will then be returned to its starting position by the force provided by the compression or extension of the spring.

Further objects and advantages of this invention will become more apparent from the following description of the preferred embodiment, which, taken in conjunction with the accompanying drawings, will illustrate, by way of example, the principles of the invention.

BRIEF DESCRIPTION OF THE DRAWINGS

The foregoing and other objects, aspects and advantages will be better understood from the following detailed description of the preferred embodiments of the invention with reference to the drawings in which.

DETAILED DESCRIPTION OF THE PREFERRED EMBODIMENTS OF THE INVENTION

In the following description of the present invention, reference is made to the accompanying drawings, which form a part thereof, and in which are shown, by way of illustration, exemplary embodiments illustrating the principles of the present invention and how it may be practiced. It is to be understood that other embodiments may be utilized to practice the present invention and structural and functional changes may be made thereto without departing from the scope of the present invention.

Figure 1:
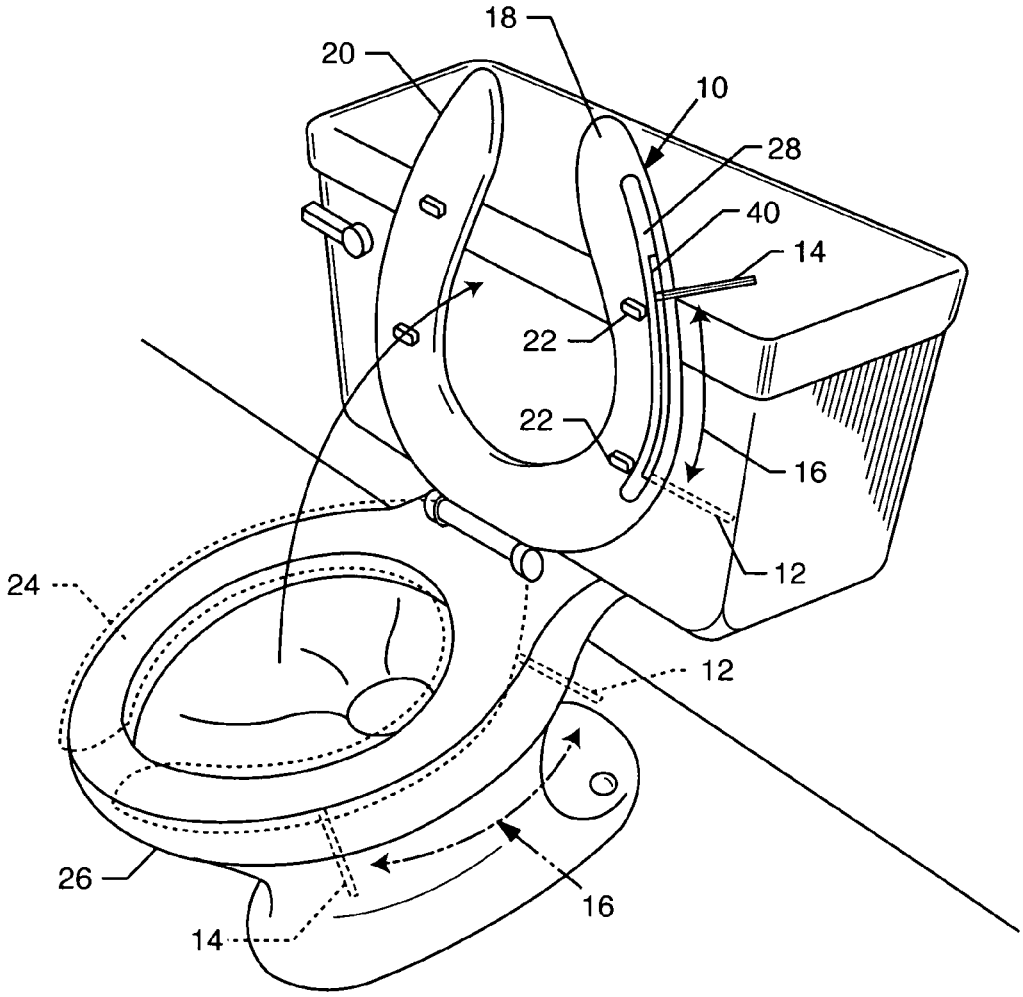
FIG. 1 illustrates a perspective view of an exemplary device according to the present invention, showing the device attached to the underside of a toilet seat.
Figure 2:
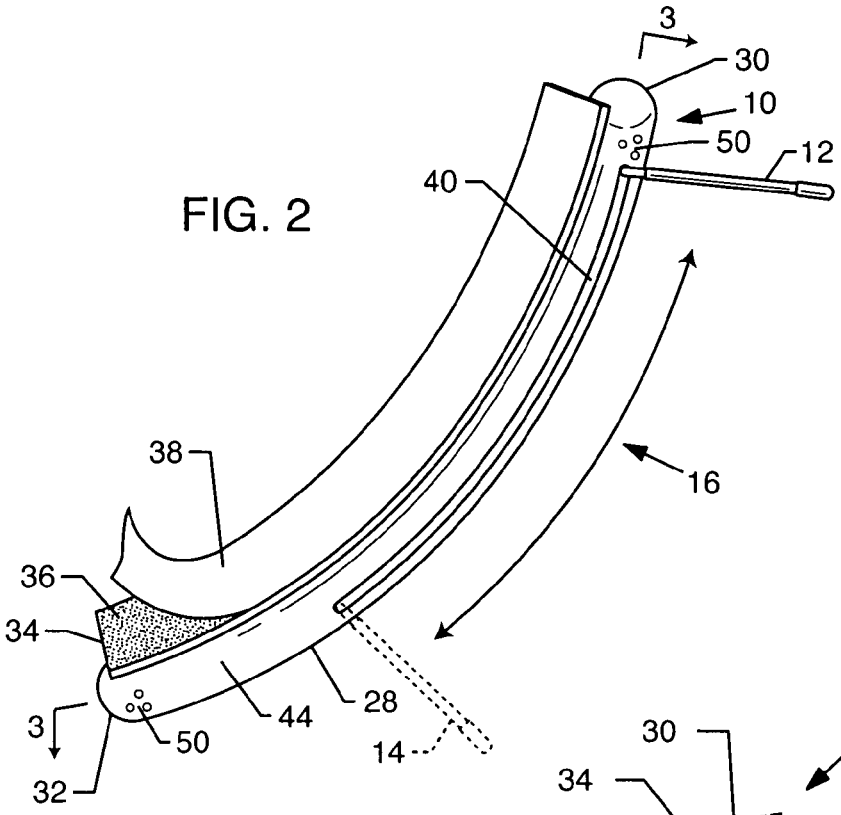
FIG. 2 illustrates a perspective view of an exemplary device according to the present invention.
Figure 3:
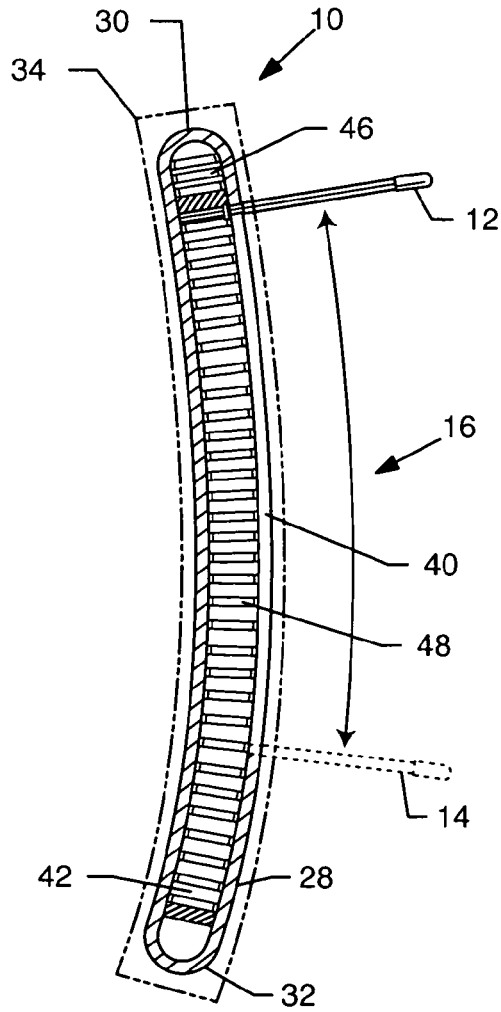
FIG. 3 illustrates a sectional view of an exemplary device according to the present invention taken at line 3—3 in FIG. 2.

A lifting apparatus according to the invention is illustrated in FIGS. 1, 2 and 3 and generally referred to by the reference numeral 10. Apparatus 10 is attached to the underside 18 of an element of a hinged structure, such as toilet seat 20. In the preferred embodiment of the invention, apparatus 10 may be attached to toilet seat 20 my means of adhesive tape or some other adhesive substance, such as glue, which will be further described herein. Apparatus 10 allows a person to lift a toilet seat 20 when it is in its down position 24 by means of a handle, which is indicated by the numeral 12 in its retracted position, and by numeral 14 when it is in its extended position.

Apparatus 10 includes enclosure 28, which in the preferred embodiment of the invention is shown as an elongated, generally cylindrical shape. Those skilled in the art will understand that enclosure 28 may take on a variety of shapes, including rectangular, for example, without departing from the scope of the invention. Enclosure 28 includes inner surface 42 and outer surface 44 and terminates at opposed first end 30 and second end 32. An elongated opening 40 follows the shape of enclosure 28. Enclosure 28 is sized so that it is not as thick as any of the lip legs 22 on underside 18 of toilet seat 20 so as not to interfere with the function of the lip legs 22. However, apparatus 10 may be incorporated in a toilet seat that has no lip legs.

In the preferred embodiment of the invention, there are mounted within inner surface 42 of enclosure 28 two springs, main spring 48 and buffer spring 46. Attached to main spring 48 is handle 12/14, which is configured to extend through opening 40. Buffer spring 46 is mounted inside inner surface 42 near first end 30. Those skilled in the art will recognize that the invention also has utility with the use of only one spring, the main spring 48.

To operate device 10, a person grasps the handle at its retracted position 12 with their fingertips and slides the handle towards them. As the handle slides towards the person, it travels along opening 40 in direction of travel 16, causing main spring 48 to compress. Once the handle reaches an extended position 14, the person releases the handle and spring 48 will cause the handle to reverse its direction of travel along opening 40 until spring 48 abuts buffer spring 46, at which point the handle reaches its retracted position 12. In this position 12, the handle is situated substantially away from the front of toilet bowl 26 and the person and so is not a hazard to the person's body or clothing. The inventor has found that apparatus 10 works well with a main spring 48 requiring very little force, so that it may be used by persons of all ages or physical conditions. At no point in the lifting operation does a person have to touch the toilet seat with his or her hands.

Apparatus 10 may be constructed integral with a toilet seat or be constructed as a separate, attachable unit. FIG. 2 illustrates one method of attachment. Enclosure 28 includes planar element 34 on outer surface 44 on which is attached an adhesive substance, which in the preferred embodiment of the invention is a two-sided adhesive tape 36. To attach this embodiment of the invention to the underside of a toilet seat, cover 38 is removed from adhesive tape 36 and secured to the underside 18 of toilet seat 20. Those skilled in the art will understand that there are several methods of attaching apparatus 10 to the toilet seat that may be utilized with the invention without departing from its scope.

Enclosure 28 further includes drain holes 50, which can provide drainage for water, cleaning solutions and the like that may enter enclosure 28.

Those skilled in the art will recognize that the present invention may be practiced without buffer spring 46. While the preferred embodiment of the invention describes main spring 48 as being extended in its normal (uncompressed) state, those skilled in the art will understand that main spring 48 may also be a compression spring. Operation of a handle mounted on a spring 48 located inside enclosure 28 and lifting toilet seat 20 will still result in the handle returning to its starting position when the handle is released when spring 48 is a compression spring.

Those skilled in the art will recognize that the present invention may be applied to a variety of hinged structures other than toilets and toilets seats, such as refuse receptacles, recycle bins, and the like.

The foregoing description of an exemplary embodiment of the present invention has been presented for purposes of enablement, illustration, and description. It is not intended to be exhaustive of or to limit the present invention to the precise forms discussed. There are, however, other configurations for lifting apparatuses not specifically described herein, but with which the present invention is applicable. The present invention should therefore not be seen as limited to the particular embodiment described herein; rather, it should be understood that the present invention has wide applicability with respect to lifting apparatuses. Such other configurations can be achieved by those skilled in the art in view of the description herein. Accordingly, the scope of the invention is defined by the following claims.

What is claimed is:

1. A lifting apparatus for mounting on the underside of a toilet seat of the type having an opening and an inner edge and an outer edge, comprising:

an enclosure generally conforming to the shape of said outer edge, said enclosure having inner and outer surfaces and opposed first and second ends;

an opening in said enclosure adjacent said outer edge;

a first spring mounted within said enclosure extending between said first and second ends when said spring is fully extended; and a handle attached to said spring, said handle extending through said opening.

2. A lifting apparatus according to claim 1 further comprising a second spring mounted within said enclosure at said first end and abutting said first spring when said first spring is fully extended.

3. A lifting apparatus according to claim 1 further comprising adhesive means attached to said outer surface.

4. A lifting apparatus according to claim 3 wherein said adhesive means is adhesive tape.

5. A lifting apparatus according to claim 3 wherein said adhesive means is glue.

6. A lifting apparatus comprising:

a toilet seat having inner and outer edges and top and bottom sides;

an enclosure attached to said bottom side, said enclosure having an inner surface and an outer surface and opposed first and second ends, said enclosure generally conforming to the shape of said outer edge;

an opening in said enclosure adjacent said outer edge;

a first spring mounted within said enclosure extending between said first and second ends when said spring is fully extended; and a handle attached to said spring, said handle extending through said opening.

7. A lifting apparatus according to claim 6 further comprising a second spring mounted within said enclosure at said first end and abutting said first spring when said first spring is fully extended.

8. A lifting apparatus for mounting on the underside of a toilet seat of the type having an opening and an inner edge and an outer edge, comprising:

an enclosure generally conforming to the shape of said outer edge, said enclosure having inner and outer surfaces and opposed first and second ends;

an opening in said enclosure adjacent said outer edge;

a spring mounted within said enclosure disposed at one of said opposed ends; and a handle attached to said spring, said handle extending through said opening.

9. A lifting apparatus according to claim 8 further comprising adhesive means attached to said outer surface.

10. A lifting apparatus according to claim 8 wherein said adhesive means is adhesive tape.

11. A lifting apparatus according to claim 8 wherein said adhesive means is glue.

12. A lifting apparatus comprising:

a toilet seat having inner and outer edges and top and bottom sides;

an enclosure attached to said bottom side, said enclosure having an inner surface and an outer surface and opposed first and second ends, said enclosure generally conforming to the shape of said outer edge;

an opening in said enclosure adjacent said outer edge;

a spring mounted within said enclosure disposed at one of said opposed ends; and a handle attached to said spring, said handle extending through said opening.

13. A lifting apparatus for mounting on a surface of a hinged structure comprising:

an enclosure generally conforming to the shape of said surface, said enclosure having inner and outer surfaces and opposed first and second ends;

an opening in said enclosure;

a first spring mounted within said enclosure extending between said first and second ends when said spring is fully extended; and a handle attached to said spring, said handle extending through said opening.

* * * * *